US005383402A

United States Patent [19]

Takano et al.

[11] Patent Number: 5,383,402

[45] Date of Patent: Jan. 24, 1995

[54] APPARATUS FOR MOUNTING PLATE ON PLATE CYLINDER

[75] Inventors: Hiroshi Takano; Takeshi Asai, both of Ibaraki, Japan

[73] Assignee: Komori Corporation, Tokyo, Japan

[21] Appl. No.: 209,607

[22] Filed: Mar. 10, 1994

Related U.S. Application Data

[63] Continuation of Ser. No. 5,477, Jan. 15, 1993, abandoned.

[30] Foreign Application Priority Data

Jan. 17, 1992 [JP] Japan ..... 4-025993

[51] Int. Cl.[6] ..... B41F 27/12; B41F 33/00

[52] U.S. Cl. ..... 101/415.1; 101/477

[58] Field of Search ..... 101/415.1, 378, 485, 101/486, DIG. 36, 409, 411, 477

[56] References Cited

U.S. PATENT DOCUMENTS 4,437,407 3/1984 Wirz et al. ..... 101/415.1

4,603,641 8/1986 Jeschke et al. ..... 101/415.1

FOREIGN PATENT DOCUMENTS 3325583 1/1985 Germany .

1321562 6/1973 United Kingdom .

*Primary Examiner*—J. Reed Fisher

*Attorney, Agent, or Firm*—Blakely, Sokoloff, Taylor & Zafman

[57] ABSTRACT

An apparatus for mounting a plate on a plate cylinder includes a plate lockup device, reference pins, and a lamp. The plate lockup device is provided in a gap formed in the circumference surface of the plate cylinder. The reference pins are electrically rendered conductive by an insertion end of a plate inserted to a gripper surface of the plate lockup device, thereby detecting insertion of the plate. The lamp confirms and indicates insertion of the plate from an output from the reference pins.

3 Claims, 6 Drawing Sheets

APPARATUS FOR MOUNTING PLATE ON PLATE CYLINDER

This is a continuation of application Ser. No. 08/005,477 filed Jan. 15, 1993 now abandoned.

BACKGROUND OF THE INVENTION

The present invention relates to a plate mounting apparatus in a printing press, which winds, on the circumferential surface of the plate cylinder, a plate having one end gripped by a leading-side plate lockup device provided in the gap formed in the outer circumferential surface of a plate cylinder, and causes a trailing-side plate lockup device in the gap in the outer circumferential surface of the plate cylinder to grip the other end of the plate, thereby mounting the plate on the plate cylinder.

In a general printing press, leading- and trailing-side plate lockup devices each including a plate lockup table and gripper plates pivotally supported by the plate lockup table are provided in a gap formed in the outer circumference surface of the plate cylinder. The leading end of a plate is gripped by the leading-side plate lockup device by the opening and closing operations of the gripper plates, and wound on the circumferential surface of the plate cylinder by rotating the plate cylinder by almost one revolution, and thereafter the gripper plates are opened and closed so that the trailing-side plate lockup device grips the trailing end of the plate, so that the plate is mounted on the plate cylinder.

In the printing operation, an ink and water are supplied to the surface of the mounted plate to form an image, and the image is transferred to paper being transported directly or through a blanket cylinder, thereby printing the image. In this printing operation, when the plate is distortedly mounted, the image is distortedly printed, degrading the quality of the printed matter. Especially, in multicolor printing, the different colors are misregistered to largely degrade the quality of the printed matter. For this reason, at the time of conventional plate making, U-shaped reference pin holes are formed in the leading end of the plate, and the plate is made with reference to these reference pin holes. Simultaneously, reference pins are provided on the plate gripper portion of the leading-side plate lockup device, and the plate is mounted while engaging the reference pin holes of the plate with these reference pins.

In such a conventional plate mounting apparatus, however, the gripper plates of the leading-side plate lockup device are opened, the end portion of the plate is inserted in the plate cylinder, the U-shaped bottom portion of the reference pin hole is brought into contact with the reference pin to position the plate, and the gripper plates are closed. That is, since whether the reference pin hole contacts the reference pin is confirmed according to the sense of the operator, a skilled operator is required. However, variations caused by the degrees of skills of the operators are inevitable, and satisfactory positioning precision cannot always be obtained. When high-precision positioning cannot be performed, a degradation in printing quality is caused.

SUMMARY OF THE INVENTION

It is an object of the present invention to provide a plate mounting apparatus capable of reliably mounting a plate on a plate cylinder.

It is another object of the present invention to provide a plate mounting apparatus for mounting a plate on a plate cylinder to provide an improved printing quality.

According to the present invention, there is provided an apparatus for mounting a plate on a plate cylinder, comprising a plate lockup device provided in a gap formed in a circumference surface of a plate cylinder, detecting means which is electrically rendered conductive by an insertion end of a plate inserted to a gripper surface of the plate lockup device, thereby detecting insertion of the plate, and indicator means for confirming and indicating insertion of the plate from an output from the detecting means.

DESCRIPTION OF THE PREFERRED EMBODIMENT

Figure 1:
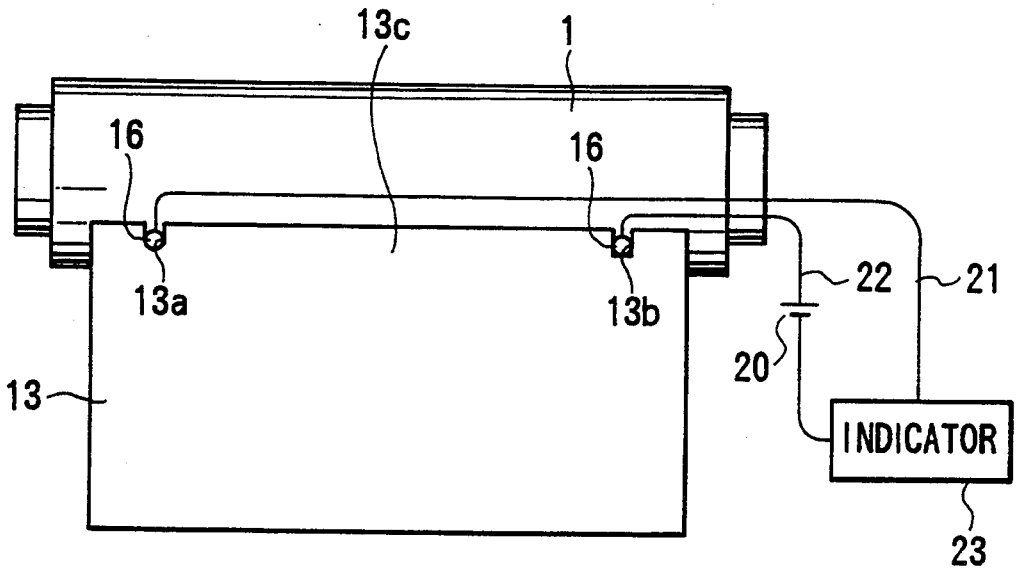
FIG. 1 is a schematic view showing the arrangement of a plate mounting apparatus.

FIGS. 1 to 5 show a plate mounting apparatus for mounting a plate on a plate cylinder according to an embodiment of the present invention. Refering to FIGS. 1 to 5, a gap 2 is formed in the outer circumferential surface of a plate cylinder 1 by substantially the entire length thereof, and two open ends of the gap 2 are closed with disk-like bearers 3. A leading-side plate lockup device 4 and a trailing-side plate lockup device (not shown) having almost the same structure as that of the leading-side plate lockup device 4 are disposed in the gap 2 to extend parallel to each other by almost the entire length of the gap 2.

Of the two plate lockup tables, the leading-side plate lockup device 4 has a plate lockup table 5 having a substantially rectangular section and extending in the axial direction of the gap 2. The plate lockup table 5 is positioned by a gauge plate 6 and fixed on the bottom surface of the gap 2 by bolts (not shown). A plurality of gripper plates 8 having substantially the same total length as that of the plate lockup table 5 and divided in the axial direction are swingably supported on the plate lockup table 5 by bolts (not shown). A cam shaft 11 having a plurality of cams each consisting of an arcuated portion 11*a* and a linear portion 11*b* is pivotally axially supported, between a plate 10 pressed by a press plate 9 to be fixed on the end faces of the gripper plates 8 and a recess hole 5*a* of the plate lockup table 5, by the two bearers 3 and an intermediate bearing (not shown).

A projecting portion 11*c* of the cam shaft 11 projecting from a bearer 3 and having an intermediate portion coupled through coupling has a hexagonal section, so that the projecting portion 11*c* can be engaged by a wrench to turn the cam shaft 11. The gripper plates 8 having gripper surfaces 8*a* are biased in the opening direction toward a gripper surface 5*b* of the plate lockup table 5 by the spring force of a spring member (not shown). The gripper plates 8 are swung by the cooperation of the pivoting operation of the cam shaft 11 and the spring force of the spring member, and the gripper surfaces 8*a* are opened away from the gripper surface 5*b*.

Figure 2:
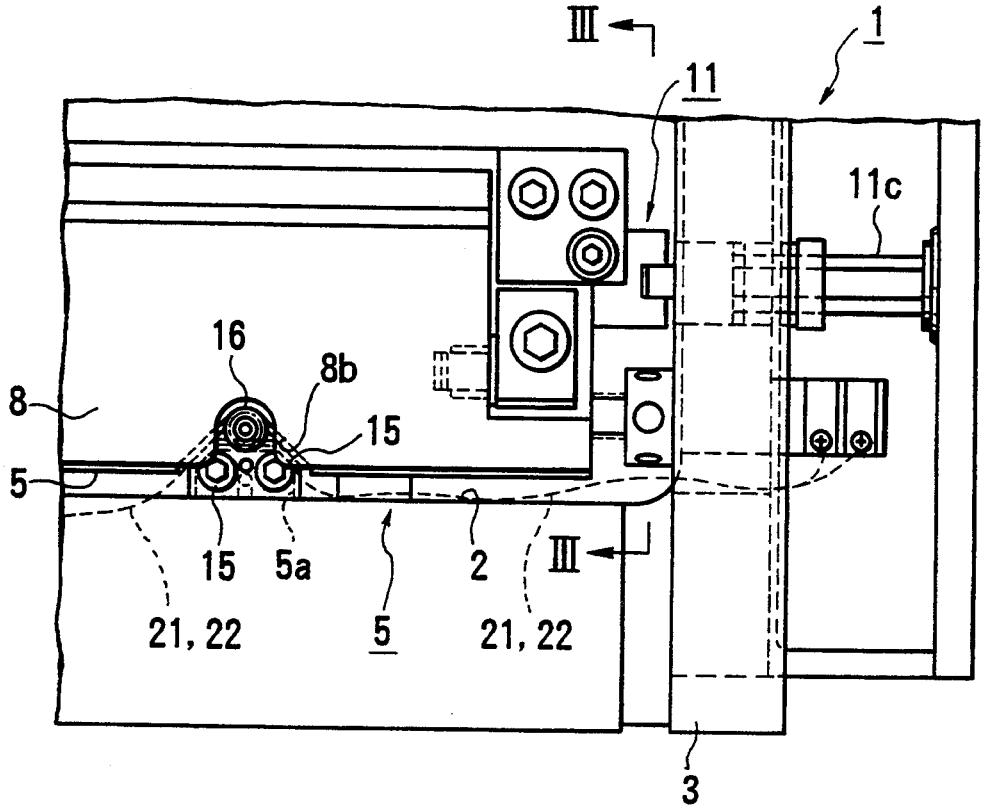
FIG. 2 is a plan view of an end portion of a plate cylinder.
Figure 3:
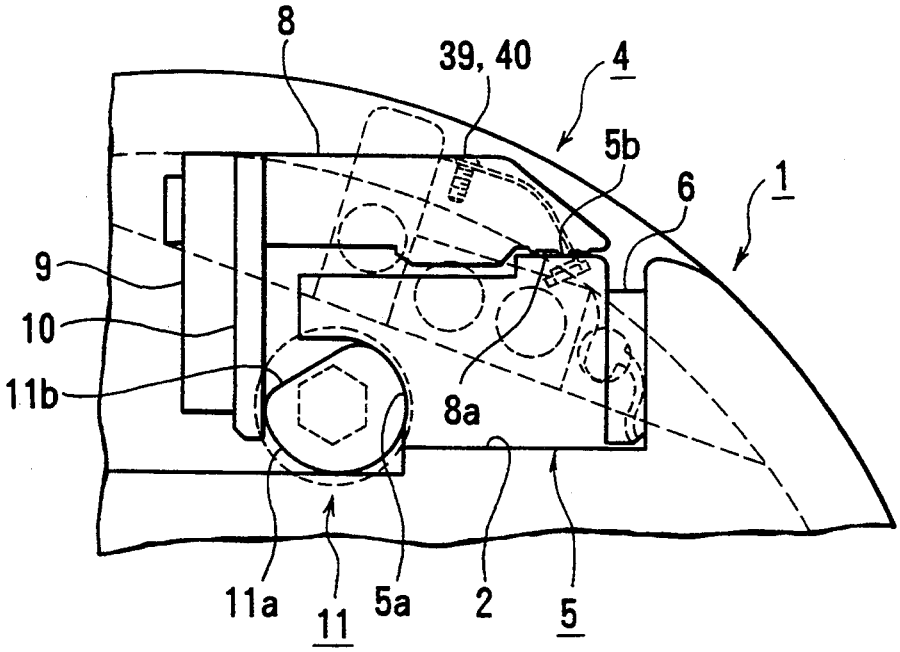
FIG. 3 is a sectional view taken along the line III—III of FIG. 2.
Figure 4:
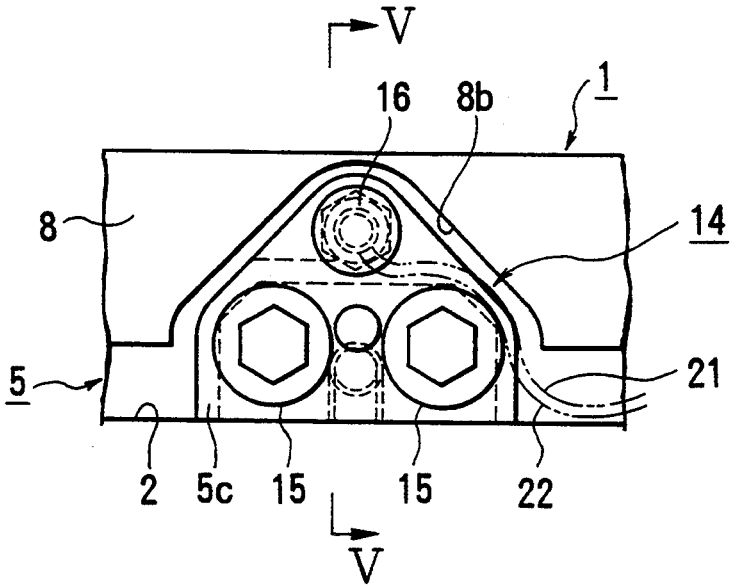
FIG. 4 is an enlarged plan view of a portion near a reference pin.
Figure 5:
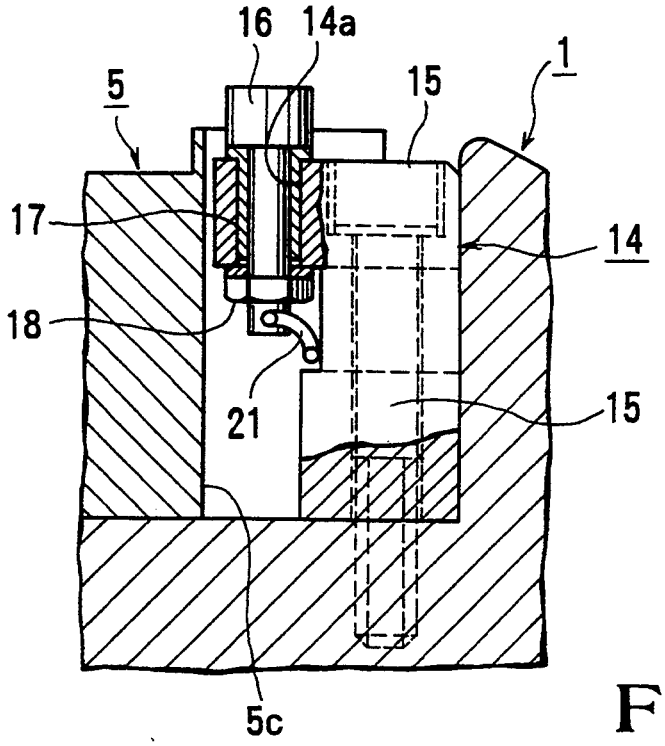
FIG. 5 is a sectional view taken along the line V—V of FIG. 4.

The plate mounting apparatus will be described. As shown in FIG. 1, U-shaped reference pin holes 13*a* and 13*b* are formed in the leading end of a plate 13 to be spaced apart from each other by a predetermined distance. Plate making is performed with reference to these reference pin holes 13*a* and 13*b*. As shown in FIGS. 2 and 4, two pairs of triangular notches 5*c* and 8*b* are formed in the plate lockup table 5 and the corresponding gripper plates 8 at positions close to the end portions thereof in the longitudinal direction, so that the notches 5*c* and 8*b* correspond to the reference pin holes 13*a* and 13*b*. As shown in the longitudinal sectional view of FIG. 5, a reference pin base 14, having a triangular shape when seen from above and an inverted L-shaped section, is housed in each pair of notches 5*c* and 8*b*, and is fixed on the bottom surface of the gap 2 by a bolt 15. Two reference pins 16 are inserted in pin holes 14*a* of the reference pin base 14 and fixed by nuts 18. The distance between the two reference pins 16 is set to be equal to the distance between the reference pin holes 13*a* and 13*b* formed in the plate 13. The reference pins 16 are engaged with the corresponding reference pin holes 13*a* and 13*b* of the plate 13 inserted between the gripper surfaces 5*b* and 8*a*.

In this plate mounting apparatus, as shown in FIG. 1, wires 21 and 22 connected to a power supply 20 are connected to the two reference pins 16 serving as the detecting portions, and the reference pins 16 are rendered conductive by an insertion end 13*c* of the conductive plate 13 inserted between the gripper surfaces 5*b* and 8*a*. More specifically, when the bottom portions of the reference pin holes 13*a* and 13*b* of the plate 13 contact the reference pins 16 to be electrically connected to them, the two reference pins 16 serving as the detecting portions are rendered conductive through the insertion end 13*c* of the plate 13. A lamp 23 serving as an indicator is provided to the stationary portion of the machine frame. The lamp 23 is turned on when the two reference pins 16 are rendered conductive through the insertion end 13*c* of the plate 13.

The operation of the plate mounting apparatus having the above-described arrangement will be described. To mount the plate 13 on the plate cylinder 1, a wrench is engaged with the projecting portion 11*c* of the cam shaft 11 to turn the cam shaft 11, to cause the linear portions 11*b* of the cams to contact the plate 10. Thus, the gripper plates 8 are swung by the spring force of the spring member to open the gripper surfaces 5*b* and 8*a*. The operator holds the leading end of the plate 13 and inserts it between the gripper surfaces 5*b* and 8*a* while engaging the reference pin holes 13*a* and 13*b* with the reference pins 16. When the bottom portions of the reference pin holes 13*a* and 13*b* corresponding to the insertion end 13*c* of the plate 13 contact the reference pins 16, the two reference pins 16 serving as the detecting portions of the plate cylinder 1 are rendered conductive by the insertion end 13*c* of the conductive plate 13. As a result, the two reference pins 16 serving as the detecting portions and the lamp 23 serving as the indicator form a loop to turn on the lamp 23, so that the operator can confirm that the plate 13 is reliably inserted.

Thereafter, the cam shaft 11 is turned to cause the arcuated portions 11*a* of the cams to contact the plate 10. Then, the gripper surfaces 5*b* and 8*a* are closed against the spring force of the spring member to grip one end of the plate 13. The plate cylinder 1 is rotated by almost one revolution to wind the plate 13 on the circumferential surface of the plate cylinder 1. The trailing-side plate lockup device is caused to grip the other end of the plate 13 in the same manner as described above, and the trailing-side plate lockup device is moved in the circumferential direction of the plate cylinder 1, so that the plate 13 is tightened and brought into tight contact with the circumferential surface of the plate cylinder 1, thus completing mounting of the plate 13. During mounting of the plate 13 as described above, the lamp 23 indicates whether the plate 13 is reliably inserted between the gripper surfaces 5*b* and 8*a* of the leading-side plate lockup device 4. Therefore, the plate 13 can be reliably gripped.

FIGS. 6 to 12 show a plate mounting apparatus for mounting a plate on a plate cylinder according to another embodiment of the present invention. Referring to FIGS. 6 to 12, the same members as those of the apparatus shown in FIGS. 1 to 5 are denoted by the same reference numerals, and a detailed description thereof will be omitted. A leading-side plate lockup device 4 and a trailing-side plate lockup device are disposed in a gap 2 of a plate cylinder 1 axially supported by frames 30. After one end of a plate 13 is gripped by the plate lockup table 5, the plate cylinder 1 is rotated to wind the plate 13 on its circumferential surface, and the other end of the plate 13 is gripped by the trailing-side plate lockup device. The plate 13 is mounted on the plate cylinder 1 in this manner.

Figure 6:
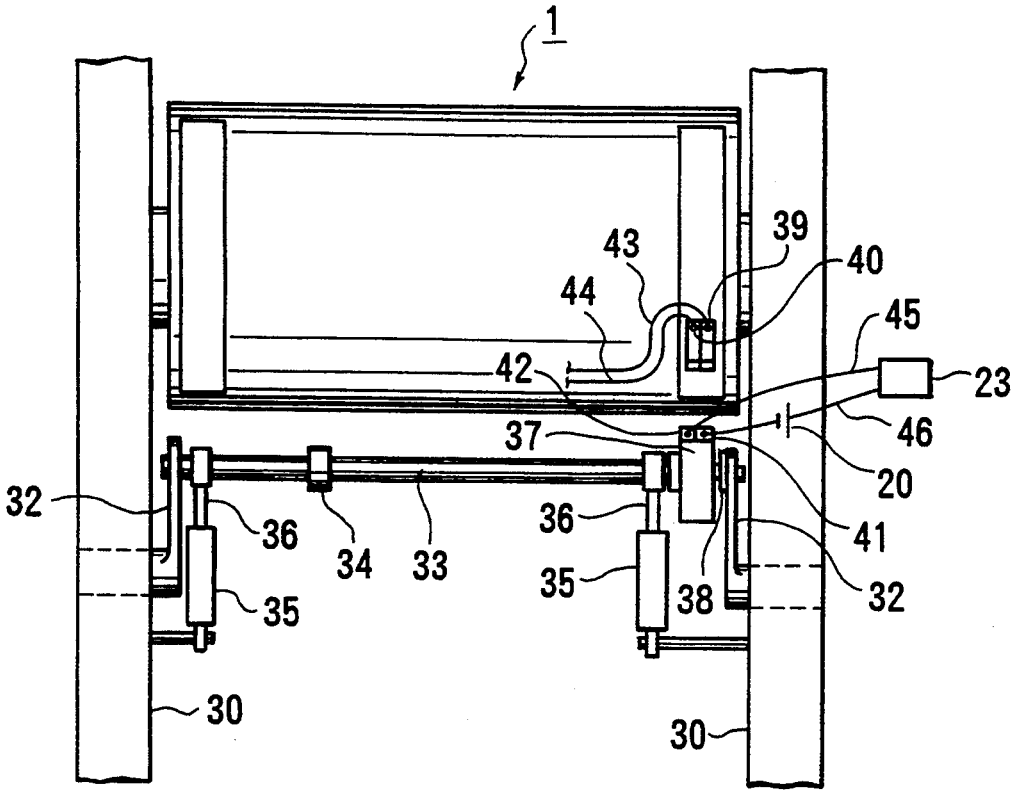
FIG. 6 is a schematic diagram showing the arrangement of the plate mounting apparatus.
Figure 7:
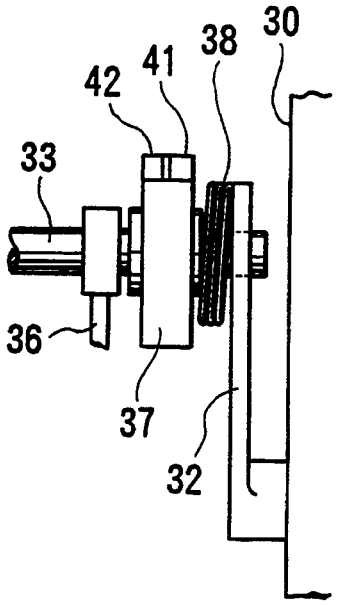
FIG. 7 is a front view of the end portion of the plate cylinder.
Figure 8:
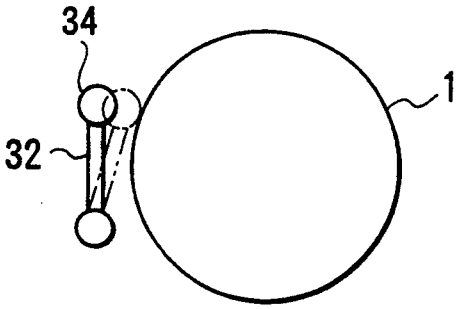
FIG. 8 is a side view of the end portion the plate cylinder.
Figure 12:
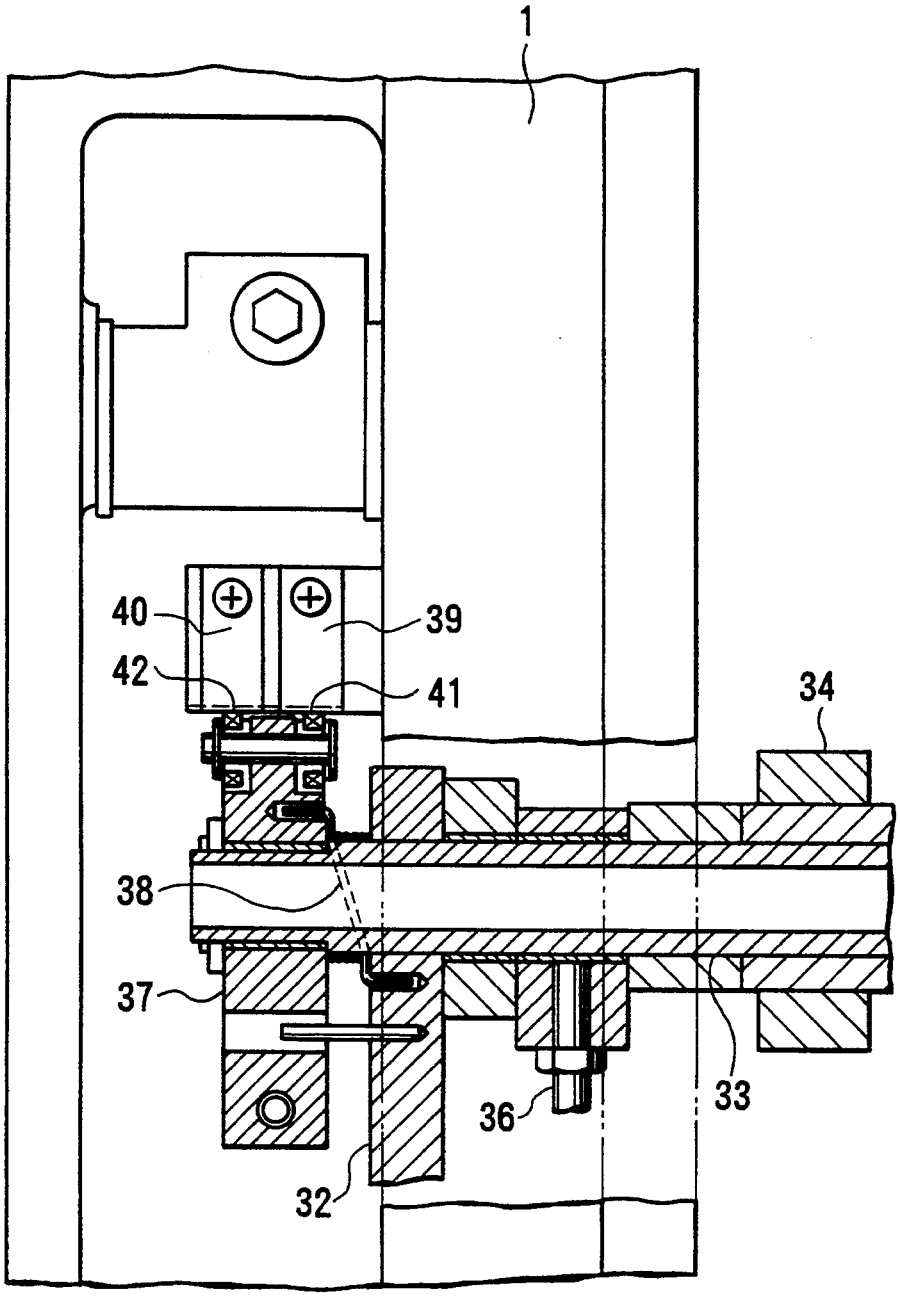
FIG. 12 is a partially cutaway front view of the end portion of the plate cylinder.

As shown in FIG. 6, roller arms 32 are pivotally mounted on the right and left frames 30, and a plurality of guide rollers 34 are axially mounted on a roller shaft 33 having two ends rotatably axially supported by the free end portions of the roller arms 32. Air cylinders 35 are pivotally mounted on the right and left frames 30, and the operating ends of piston rods 36 of the air cylinders 35 are pivotally coupled to the roller shaft 33. As shown in FIG. 7, a contact lever 37 is pivotally supported on one end of the roller shaft 33 by interposing a torsion coil spring 38 between the contact lever 37 and the roller arms 32. As shown in FIG. 12, contact rollers 41 and 42 corresponding to contacts 39 and 40 provided to the plate cylinder 1 are pivotally mounted on the free end of the contact lever 37. The contacts 39 and 40 are located at predetermined positions on the end face of the plate cylinder 1 so that they contact the contact rollers 41 and 42 only when the plate cylinder 1 is kept stopped in the plate gripping operation. As shown in FIG. 6, wires 43 and 44 connected to the contacts 39 and 40 are connected to the two reference pins 16 in the same manner as in FIG. 1. As shown in FIG. 6, the contact rollers 41 and 42 are connected to the power supply 20 and the lamp 23 serving as the indicator through wires 45 and 46. When the contacts 39 and 40 are brought into tight contact with the contact rollers 41 and 42, they are connected to the power supply 20.

The operation of the plate mounting apparatus having the above-described arrangement will be described. To mount the plate 13 on the plate cylinder, a wrench is engaged with a projecting portion 11*c* of a cam shaft 11 to turn the cam shaft 11, to cause the linear portions 11*b* of the cams to contact the plate 10. Thus, gripper plates 8 are swung by the spring force of a spring member to open gripper surfaces 5*b* and 8*a*. The operator holds the leading end of the plate 13 and inserts it between the gripper surfaces 5*b* and 8*a* while engaging reference pin holes 13*a* and 13*b* with reference pins 16. When the bottom portions of the reference pin holes 13*a* and 13*b* corresponding to an insertion end 13*c* of the plate 13 contact the reference pins 16, the two reference pins 16 serving as the detecting portions of the plate cylinder 1 are rendered conductive by the plate 13, thereby forming a loop.

Figure 9:
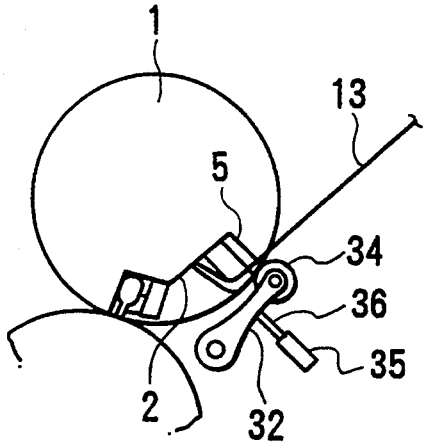
FIG. 9 is a side view of the end portion of the plate cylinder showing a state wherein a plate is being inserted.
Figure 10:
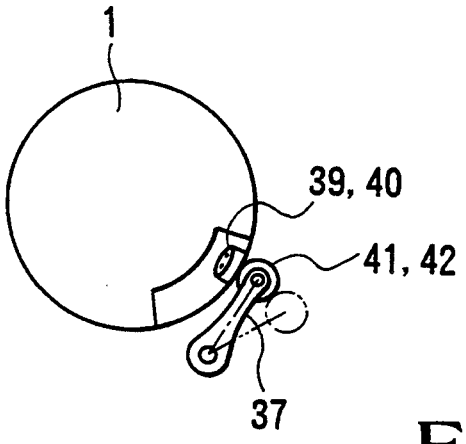
FIG. 10 is a side view of the end portion of the plate cylinder showing a state wherein detecting portions are rendered conductive.
Figure 11:
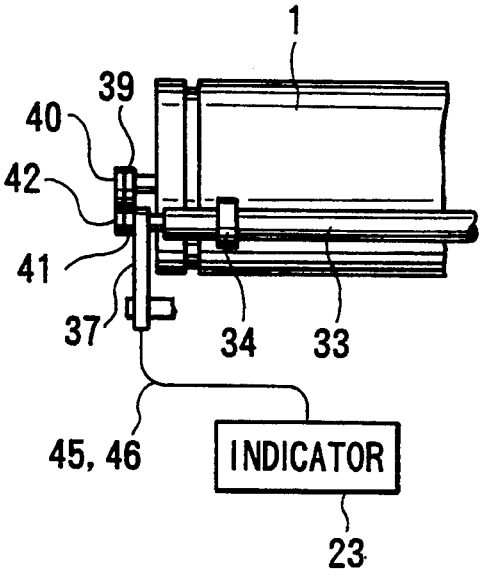
FIG. 11 is a schematic front view of the end portion of the plate cylinder.

When the plate 13 is to be inserted between the gripper surfaces 5*b* and 8*a*, as shown in FIG. 9, the piston rods 36 of the air cylinders 35 are moved forward to swing the roller arms 32, and the plurality of guide rollers 34 are moved to the guide position of the plate cylinder 1. Hence, one end of the plate 13 is guided to a portion between the gripper surfaces 5*b* and 8*a* by the guide rollers 34, and is reliably inserted between them. Upon movement of the guide rollers 34, the contact lever 37 coaxial with the roller arms 32 is swung, and as shown in FIG. 10, the contact rollers 41 and 42 are brought into tight contact with the contacts 39 and 40 while absorbing the force by the torsion coil spring 38. Then, the contact 39 and the contact roller 41, and the contact 40 and the contact roller 42 are rendered conductive. In addition, since the two reference pins 16 have been rendered conductive by the plate 13, a loop is formed by the reference pins 16 serving as the detecting portions and the lamp 23 serving as the indicator, and the lamp 23 is turned on.

When the lamp 23 is turned on and it is confirmed that the plate 13 is reliably inserted, the cam shaft 11 is turned to cause the arcuated portions 11*a* of the cams to contact the plate 10. As a result, the gripper surfaces 5*b* and 8*a* are closed against the spring force of the spring member to grip one end of the plate 13. The plate cylinder 1 is rotated by almost one revolution to wind the plate 13 on the circumferential surface of the plate cylinder 1. The trailing-side plate lockup device is caused to grip the other end of the plate 13 in the same manner as described above, and the trailing-side plate lockup device is moved in the circumferential direction of the plate cylinder 1, so that the plate 13 is tightened and brought into tight contact with the circumferential surface of the plate cylinder 1, thus completing mounting of the plate 13.

In the embodiments described above, the reference pins 16 are used also as the electrodes. However, electrodes may be provided independently of the reference pins. If, however, the reference pins are used also as the electrodes, the number of components is decreased.

As is apparent from the above description, according to the plate mounting apparatus according to the present invention for mounting a plate on the plate cylinder, detecting portions, which are rendered conductive by the insertion end of a plate inserted between the gripper surfaces of the gripper plates and the gripper surface of the plate lockup table, and an indicator indicating that the detecting portions are rendered conductive are provided. Therefore, during the mounting operation of the plate on the plate cylinder, the indicator, e.g., a lamp or a buzzer, informs that the plate is completely inserted between the gripper surfaces of the gripper plates and the gripper surface of the plate lockup table. Insertion becomes reliable as compared to conventional insertion which is done according to the sense of the operator, and variations caused by the degrees of skills of the operators are eliminated, thereby improving the quality of the printed matter.

Furthermore, the detecting portions are provided to the plate cylinder which is a rotary member, the indicator is provided to the stationary portion of the machine frame, and contacts are provided to render the detecting portions and the indicators conductive when the plate cylinder is stopped. Therefore, since the contacts for closing the electrical circuit are not closed during rotation of the plate cylinder, but are closed when the plate cylinder is kept stopped, the durability of the components forming the contact portions is improved. In addition, the problem of wiring between the plate cylinder as the rotary member and the indicator can be solved.

What is claimed is:

1. An apparatus for mounting a plate on a plate cylinder, comprising:

a plate lockup device provided in a gap formed in a circumferential surface of a plate cylinder;

detecting means which is electrically rendered conductive by an insertion end of a plate inserted to a gripper surface of said plate lockup device, thereby detecting insertion of the plate, said detecting means being provided to said plate cylinder serving as a rotary member;

indicator means for confirming and indicating insertion of the plate on the basis of an output from said detecting means, said indicator means being provided to a stationary portion of a machine frame; and connecting means for connecting said detecting means and said indicating means, said connecting means comprising a pair of contacts formed on the plate cylinder and a pair of contact members provided on the stationary portion of said machine frame, said pair of contact members being brought into tight contact with said pair of contacts when the plate is inserted to said plate lockup device to be gripped.

2. An apparatus according to claim 1, further comprising a guide member for guiding the plate to said gripper surface of said plate lockup device when the plate is gripped, and wherein said pair of contact members are brought into tight contact with said contacts in synchronism with an operation of said guide member.

3. An apparatus according to claim 1, wherein said pair of contact members comprises a pair of contact rollers.

* * * * *